US006241049B1

(12) United States Patent
Gooch

(10) Patent No.: US 6,241,049 B1
(45) Date of Patent: Jun. 5, 2001

(54) APPARATUS FOR STORING VEHICLES WITH MULTIPLE SUPPORT PLATFORMS, COLLAPSIBLE SUPPORTS BETWEEN PLATFORMS, AND A TORQUE-REACTION ARM LIFT SYSTEM

(76) Inventor: William C. Gooch, 3663 Popplewell, Fort Worth, TX (US) 76118-5114

( * ) Notice: Subject to any disclaimer, the term of this patent is extended or adjusted under 35 U.S.C. 154(b) by 0 days.

(21) Appl. No.: 09/318,542

(22) Filed: May 25, 1999

Related U.S. Application Data

(60) Provisional application No. 60/086,793, filed on May 26, 1998.

(51) Int. Cl.[7] ..... B66B 1/28; B66F 7/12

(52) U.S. Cl. ..... 187/285; 187/213; 414/240

(58) Field of Search ..... 187/203, 209, 187/210, 216, 217, 213, 285, 413; 414/227, 228, 231, 242, 246, 249, 240

(56) References Cited

U.S. PATENT DOCUMENTS 3,712,485 * 1/1973 Klaus ..... 214/16
3,750,899 * 8/1973 Greer ..... 214/16
3,844,421 * 10/1974 Nielsen ..... 214/1 A
4,015,733 * 4/1977 Woehr ..... 214/16
4,674,938 * 6/1987 Van Stkes et al. ..... 414/228
5,025,892 * 6/1991 Stezl ..... 187/8.92
5,035,562 * 7/1991 Rosen ..... 414/227
5,156,238 * 10/1992 Matthews ..... 187/8.72
5,335,755 * 8/1994 Miller ..... 187/8.77
5,622,466 * 4/1997 Rossato ..... 414/228

* cited by examiner

*Primary Examiner*—Jonathan Salata
(74) *Attorney, Agent, or Firm*—Melvin A. Hunn

(57) ABSTRACT

An apparatus is provided for storing vehicles. A vertical support structure is mechanically coupled to a horizontal support structure. Multiple support platforms are provided, including at least an upper vehicle support platform and a lower vehicle support platform. At least one lift arm is pivotally coupled between the vertical support structure and the upper vehicle support platform. A collapsible linkage connection is provided between the upper vehicle support platform and the lower vehicle support platform. A lower vehicle support platform is suspendable below the upper vehicle support platform by the collapsible linkage connection. A control system is utilized to operate the at least one lift arm in order to move the apparatus between modes of operation. In a first vehicle loading position, the upper vehicle support platform and the lower vehicle support platform are in a down position with the upper vehicle support platform directly above the lower vehicle support platform. In the second vehicle loading position, the upper vehicle support platform is elevated a predetermined distance above the lower vehicle support platform, but with the lower vehicle support platform in a down position substantially in engagement with a flooring. In a third vehicle loading position, the upper vehicle support platform and the lower vehicle support platform are disposed predetermined distances above the flooring, with the lower vehicle support platform suspended from the upper vehicle support platform by the collapsible linkage connection.

50 Claims, 13 Drawing Sheets

11

11

123

APPARATUS FOR STORING VEHICLES WITH MULTIPLE SUPPORT PLATFORMS, COLLAPSIBLE SUPPORTS BETWEEN PLATFORMS, AND A TORQUE-REACTION ARM LIFT SYSTEM

CROSS-REFERENCE TO RELATED APPLICATION

This application claims the benefit of the filing date of U.S. Provisional Patent Application Serial No. 60/086,793; filed May 26, 1998, entitled IMPROVED VEHICLE STACKING SYSTEM, with William C. Gooch of Fort Worth, Tex. as sole inventor.

BACKGROUND OF THE INVENTION

1. Field of the Invention

The present invention relates in general to vehicle stacking systems.

2. Description of the Prior Art

Vehicle stacking systems are utilized to maximize the use of parking garage space. Typically, vehicle stacking systems will stack two or three automobiles vertically utilizing a lifting apparatus and a plurality of vehicle platforms which are selectively moved upward and downward by the lifting apparatus. A variety of competing design considerations must be balanced in constructing and utilizing vehicle stacking systems. First, the vehicle stacking systems must be economical. If the price of the apparatus is too high, this will make the parking facility less competitive and thus less attractive to its potential and actual customers. Second, the vehicle stacking system should be either aesthetically pleasing or relatively unobtrusive. This is true because many urban areas have fairly restrictive ordinances which requirement concealment of large pieces of equipment, such as vehicle stacking devices. Third, the device must be safe, since there is always a potential for personal injury and the loss of property should the device malfunction. Fourth, the vehicle lifting system should be easy to use. It should be easy to use for the operator of the device and additionally it should be easy to use for the customers that park their vehicles in the system. In prior art devices, the efficient use of ground space was in direct conflict with customer comfort and convenience. The prior art systems typically provide little or no room for ingress and egress to and from the vehicle by the customer after the vehicle is parked on a lift platform. The present invention balances these competing design considerations and provides a novel and economical solution to problems which exist in the current state of the art of vehicle stacking systems.

SUMMARY OF THE INVENTION

The present invention is directed to an improved car stacking apparatus which includes a number of novel features which together or in combination provide significant advantages over the state of the prior art. Preferably, but not necessarily, these novel features are implemented in a multiple-car stacking apparatus, preferably an apparatus which is utilized to park or store three automobiles. Some features are susceptible for utilization in two car stacking systems, and all features can be utilized in stacking systems which stack more than three cars, although such systems are extremely uncommon. The principal car stacking systems of the prior art include two car stacking systems and three car stacking systems.

One novel feature of the present invention is to utilize a collapsible linkage connection between an upper vehicle support platform and a lower vehicle support platform. In this manner, the entire load of the lower vehicle support platform (and the vehicle carried thereon) is carried by the upper vehicle support platform and transferred through a collapsible linkage member. In the preferred embodiment of the present invention, the collapsible linkage member comprises a plurality of chains which serve to suspend a lower vehicle platform member directly beneath an upper vehicle platform member. In accordance with the preferred embodiment of the present invention, three vehicle loading positions are defined, each corresponding to the storage or parking of a separate vehicle. In a first loading position, the upper vehicle support platform and the lower vehicle support platform are in a down position with the upper vehicle support platform directly above the lower vehicle support platform. In this position, the vehicle is driven onto the upper vehicle support platform, and parked thereon. In the second vehicle loading position, the upper vehicle support platform is elevated a predetermined distance above the lower vehicle support platform. However, the lower vehicle support platform is maintained in a down position substantially in engagement with the flooring. A second vehicle is then driven onto the lower vehicle support platform, and parked thereon. In the third vehicle loading position, the upper vehicle support platform and lower vehicle support platform are elevated predetermined distances above the flooring. Then, a third vehicle is driven into position underneath the lower vehicle support platform, and parked thereon. The utilization of a collapsible linkage member between the upper and lower vehicle support platforms facilitates this type of operation. It allows for easy stacking of the upper and lower vehicle support platforms. The utilization of a collapsible linkage such as a chain is a very easy way to allow for secure mechanical connection, and is perfect for suspending the lower vehicle support platform underneath the upper vehicle support platform.

Certain advantages flow from utilizing collapsible linkage members to couple the vehicle support platforms to one another. Preferably, the collapsible linkage members are symmetrically positioned along the outer edges of the upper and lower vehicle support platforms. Preferably, but not necessarily, they are located proximate the front and rear tires of the vehicle, since this is where the load of the vehicle is transferred. In accordance with the preferred embodiment of the present invention, at least one lift arm is pivotally coupled between a vertical support structure and the upper vehicle support platform. Additionally, a reaction arm is also coupled between the vertical support structure and the upper vehicle support platform. In the preferred embodiment of the present invention, a torque bar is also coupled between the vertical support structure and the upper vehicle support platform. All of these items are pivotally coupled between the vertical support structure and the upper vehicle support platform. In accordance with the preferred embodiment of the present invention, the upper vehicle support platform is moved through a predetermined arc as it is moved between the first, second, and third vehicle loading positions. The collapsible linkage connection between the upper vehicle support platform and the lower vehicle support platform is laid down neatly beside the parking apparatus as the upper vehicle support platform is moved between the second vehicle loading position and the first vehicle loading position. This minimizes the possibility of entanglement of the collapsible linkage member, and is especially useful when chains are utilized as a collapsible linkage member. Conversely, as the upper vehicle support platform is moved upward from a first vehicle loading position to a second vehicle loading position, the collapsible linkage member is pulled upward as needed, again minimizing the opportunity for entanglement.

The present invention utilizes a rotatable connection member in order to facilitate the movement of the moving portions of the storage apparatus (as well as the center of gravity of the entire apparatus and automobiles combined) through a predefined arcuate pathway. The travel path is largely upward and downward, with very little lateral movement (as will be described and depicted in the detailed description). This maintains the center of gravity in a substantially uniform location, and also allows for several other advantageous features in addition to the previously mentioned feature of allowing the utilization of collapsible linkage members, such as chains or cables. In accordance with the preferred embodiment, the rotatable connection member pivotally connects at least one adjustable-link lift arm and at least one reaction arm to an upper vehicle support platform.

The present invention also includes another novel feature over the state of the prior art. In accordance with the present invention, the lift apparatus is utilized to slightly tilt the vehicle support platforms one direction during loading operations, and in an opposition direction during lifting and storing operations. When the cars are lifted and stored, the forward end of the vehicle support platform is maintained in a slightly lower position than the distal end of the vehicle support platform, assuming that the vehicles are loaded with the front end of the vehicle toward the vertical support structure, this results in a gravity bias of the vehicle toward the vertical support structure (and associated wall) which increases safety, and reduces the risk of loss and harm, in the event that the vehicle braking system has not been properly set. Thus, if the brakes are not set, the vehicle will roll forward into contact with the wall which is utilized to support the vertical support structure at the forward end of the vehicle support platform. The vehicle will not roll backward off of the platform, thus minimizing the risk of accidents. In contrast, however, when the upper and lower vehicle support platforms are in a down loading position, the lifting apparatus maintains the forward end of the vehicle support platform slightly elevated relative to the distal end of the vehicle support platform, allowing the vehicle support platform to serve in part as a ramping structure to facilitate loading of vehicles onto the upper and lower vehicle support platforms.

This advantage is obtained by having structural components which define a generally parallelogram shape. In the preferred embodiment of the present invention, the generally parallelogram shape is defined by a torque bar, a reaction arm, and the connection points that the torque bar and reaction arm have with both the vertical support structure and the upper vehicle support platform. Preferably, the torque bar and reaction arm are of identical length. Additionally, the torque bar and reaction arm are pivotally coupled to the upper vehicle support platform a predetermined distance apart (for example, fourteen inches apart). In contrast, the torque bar and reaction arm are pivotally connected to a vertical support structure (which is preferably secured to a wall or adjoining wall) a predetermined distance which is a bit shorter than the spacing between the pivotal connections at the upper vehicle support platform (for example, thirteen inches). The slight difference in distance (for example, one inch) between the pivotal connection points results in a slight elevation of the forward end of the vehicle support platform relative to the distal end to allow loading. In contrast, during and after elevation of the vehicle support platforms, the difference in distance between the pivotal connections of the torque bar and reaction arm results in a slight lowering of the forward end of the vehicle support platform relative to the distal ends, resulting in a gravity bias of the vehicles to a forward position, enhancing safety.

Another advantageous feature of the present invention is the structure of the upper vehicle support platform. In the preferred embodiment, the upper vehicle support platform is made up of a platform cradle which is composed of a plurality of load bearing members, including a pair of elongated parallel side support members which are substantially parallel to the longitudinal axis of a vehicle positioned with the apparatus. Additionally, the upper vehicle support platform includes a platform member which is adapted in length and width to receive and support a vehicle. Preferably, the platform member includes a lower cavity which is adapted to mechanically mate with the platform cradle. In other words, the platform member is strong enough to support a vehicle, but need not be strong enough to support the platform and vehicle which are suspended thereunder. The platform cradle is the load bearing structure which supports the weight of the platform member (and the vehicle located thereon) as well as the weight of the lower vehicle support platform (and the vehicle located thereon). In accordance with this embodiment, the lower vehicle support platform is coupled to the platform cradle utilizing a collapsible connection. In the preferred embodiment, the collapsible connection comprises a plurality of chain members which extend from the lower vehicle support platform to the platform cradle. The advantage of this construction is that the function which must be performed by the platform member (supporting a vehicle) can be separated from the function of the platform cradle, which is supporting at least twice that weight, since it supports the lower vehicle support platform and vehicle in addition to the platform member. This is advantageous since the apparatus can be substantially constructed before requiring the placement of the platform member on the platform cradle. In the preferred embodiment, the platform member includes a lower cavity which mechanically mates on top of the platform cradle. Typically, the cavity is generally rectangular, so the platform member may be formed from flat sheets of metal with orthogonal side portions which extend down around the platform cradle. The platform member can be lifted into position utilizing a forklift or other lifting equipment. However, the storing apparatus can be substantially constructed without requiring the placement of the platform member into position. Once the upper vehicle support platform is constructed, the collapsible connection (preferably chains) can be utilized to secure the lower vehicle support platform to the platform cradle.

The present invention includes another novel feature which is advantageous over the prior art. In accordance with the preferred embodiment, in the down position, the upper vehicle support platform is located directly above the lower vehicle support platform. In fact, it is at rest upon the lower vehicle support platform. In this mode of operation, the upper and lower vehicle support platforms are staggered into position relative to one another. Additionally, the distal ends of the upper and lower vehicle support platforms are slightly inclined. The combination of inclined distal ends which are slightly staggered in position results in the upper and lower vehicle support platforms collectively defining a ramping structure which facilitates the loading of a vehicle onto the upper vehicle support platform. When the upper vehicle support platform is moved upward, the inclined distal end of the lower vehicle support platform defines a shorter ramping structure which facilitates the loading of a vehicle onto the lower vehicle support platform.

The above as well as additional objectives, features, and advantages will become apparent in the following description.

DETAILED DESCRIPTION OF THE INVENTION

Figure 1:
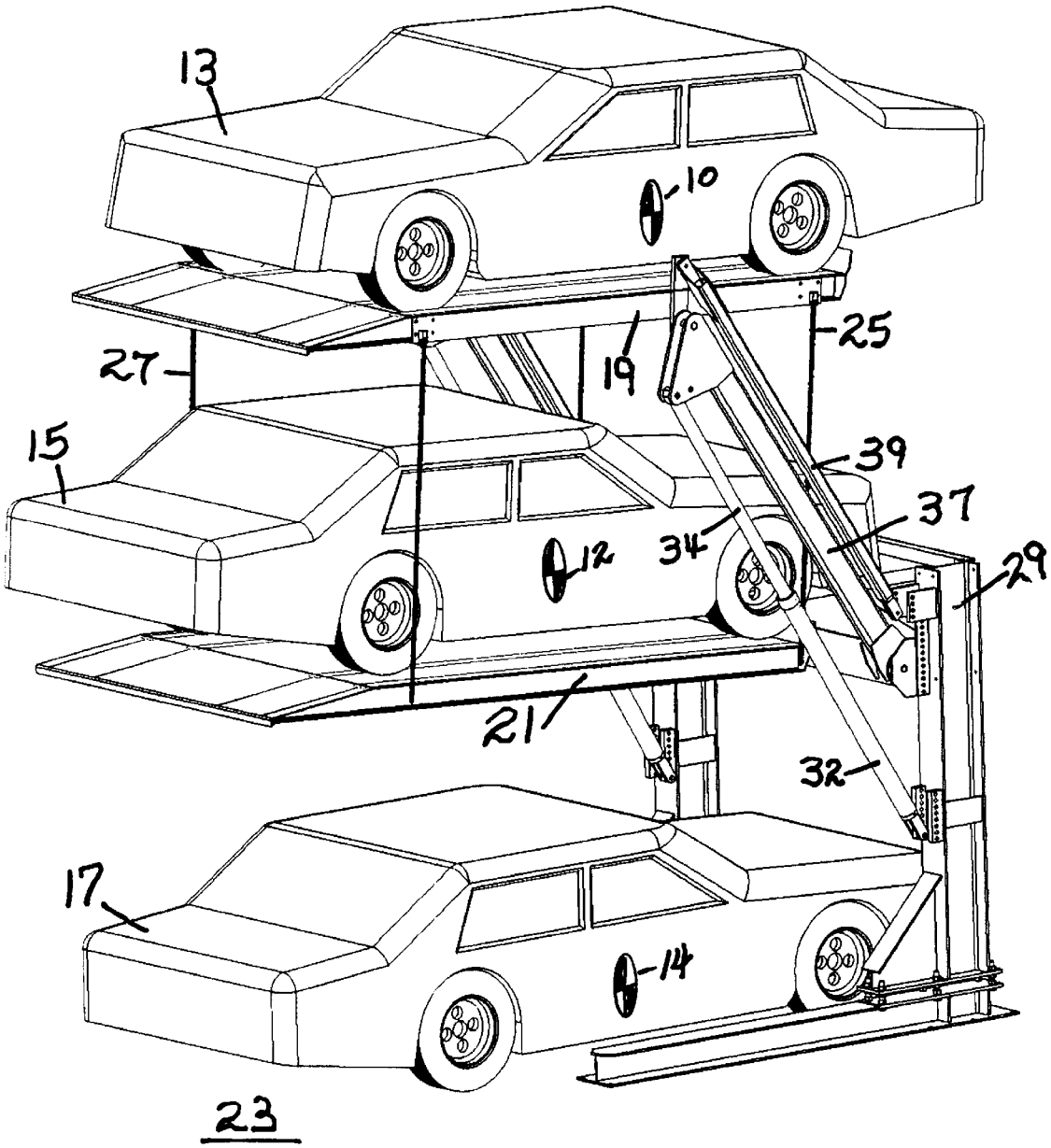
FIG. 1 is a fragmentary and pictorial representation of a the vehicle stacking apparatus of the present invention, in a fully loaded condition.

FIG. 1 is a simplified, pictorial, and fragmentary representation of the improved vehicle stacking system 11 of the present invention with vehicles 13, 15, 17, disposed therein. As is shown, vehicle 13 is carried on vehicle support platform 19, and is located at an uppermost position within the improved vehicle stacking system 11 of the present invention. Vehicle 15 is disposed on vehicle support platform 21 which is maintained directly beneath vehicle support platform 19, and which is preferably suspended therefrom by a collapsible linkage system, such as a plurality of chains, such as chains 25, 27 and other chains not depicted in this view.

One novel feature of the present invention is to utilize the collapsible linkage connection between an upper vehicle support platform and a lower vehicle support platform. In this manner, the entire load of the lower vehicle support platform (and the vehicle carried thereon) is carried by the upper vehicle support platform and transferred through the collapsible linkage member. In the preferred embodiment of the present invention, the collapsible linkage member comprises a plurality of chains which serve to suspend a lower vehicle platform member directly beneath an upper vehicle platform member. In accordance with the preferred embodiment of the present invention, three vehicle loading positions are defined, each corresponding to the storage or parking of a separate vehicle. In a first loading position, the upper vehicle support platform and the lower vehicle support platform are in a down position with the upper vehicle support platform directly above the lower vehicle support platform. In this position, the vehicle is driven onto the upper vehicle support platform, and parked thereon. In the second vehicle loading position, the upper vehicle support platform is elevated a predetermined distance above the lower vehicle support platform. However, the lower vehicle support platform is maintained in a down position substantially in engagement with the flooring. A second vehicle is then driven onto the lower vehicle support platform, and parked thereon. In the third vehicle loading position, the upper vehicle support platform and lower vehicle support platform are elevated predetermined distances above the flooring. Then, a third vehicle is driven into position underneath the lower vehicle support platform, and parked thereon. The utilization of a collapsible linkage member between the upper and lower vehicle support platforms facilitates this type of operation. It allows for easy stacking of the upper and lower vehicle support platforms. The utilization of a collapsible linkage such as a chain is a very easy way to allow for secure mechanical connection, and is perfect for suspending the lower vehicle support platform underneath the upper vehicle support platform.

Certain advantages flow from utilizing collapsible linkage members to couple the vehicle support platforms to one another. Preferably, the collapsible linkage members are symmetrically positioned along the outer edges of the upper and lower vehicle support platforms. Preferably, but not necessarily, they are located proximate the front and rear tires of the vehicle, since this is where the load of the vehicle is transferred. In accordance with the preferred embodiment of the present invention, at least one lift arm is pivotally coupled between a vertical support structure and the upper vehicle support platform. Additionally, a reaction arm is also coupled between the vertical support structure and the upper vehicle support platform. In the preferred embodiment of the present invention, a torque bar is also coupled between the vertical support structure and the upper vehicle support platform. All of these items are pivotally coupled between the vertical support structure and the upper vehicle support platform. In accordance with the preferred embodiment of the present invention, the upper vehicle support platform is moved through a predetermined arc as it is moved between the first, second, and third vehicle loading positions. The collapsible linkage connection between the upper vehicle support platform and the lower vehicle support platform is laid down neatly beside the parking apparatus as the upper vehicle support platform is moved between the second vehicle loading position and the first vehicle loading position. This minimizes the possibility of entanglement of the collapsible linkage member, and is especially useful when chains are utilized as a collapsible linkage member. Conversely, as the upper vehicle support platform is moved upward from a first vehicle loading position to a second vehicle loading position, the collapsible linkage member is pulled upward as needed, again minimizing the opportunity for entanglement.

Vehicle 17 is located in the lowermost position within the improved vehicle stacking system 11 of the present invention, and is in engagement with the flooring 23 of the parking structure. A plurality of vertical support members, such as vertical support member 29 is provided in a position which is proximate the front of the parked vehicles. Preferably, vertical support member 29 is a relatively unobtrusive member. A lift system 31 is provided which mechanically couples members between coupled upper vehicle support platform 19 and vertical support member 29. Lift system 31 preferably includes a plurality of hydraulic cylinders 35 which include a stationary cylinder portion, such as cylinder portion 32, and a movable piston portion, such as piston portion 34. In the preferred embodiment of the present invention, a novel hydraulic cylinder is utilized which will be discussed below in greater detail. Lifting system 31 further includes a torque bar 37 which is coupled between vertical support member 29 and upper vehicle support platform 19. Lift system 31 further includes reaction arm 39 which is coupled between vertical support member 29 and upper vehicle support platform 19. As is shown, the upper and lower vehicle support platforms 19, 21 are raised and lowered as hydraulic cylinder 35 is actuated through arc 33. In the view of FIG. 1, the centers of gravity 10, 12, 14 of vehicles 13, 15, 17 are depicted. Other details associated with the construction and operation of the improved vehicle stacking system of the present invention become clear with respect to the other figures.

Figure 2A:
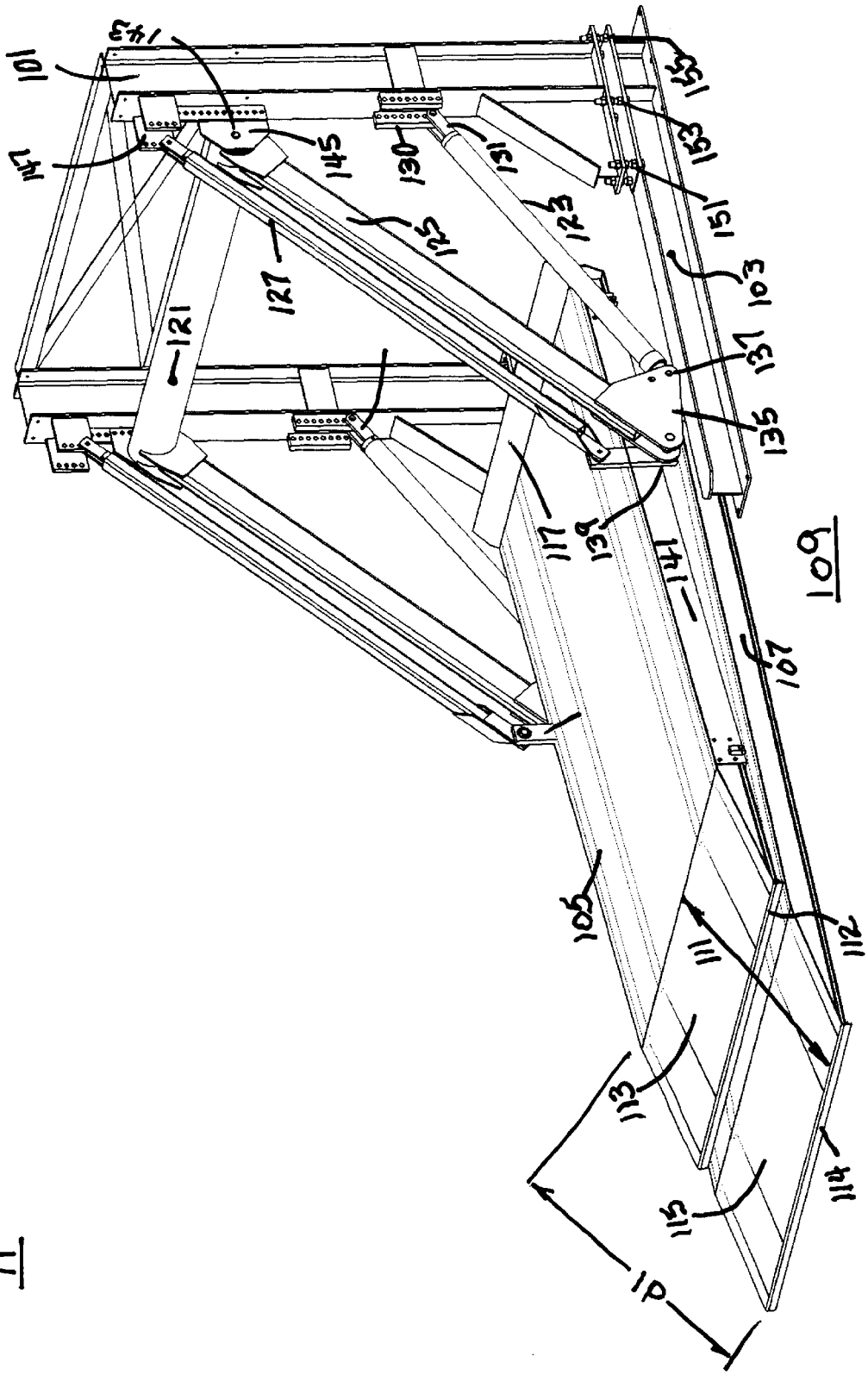
FIG. 2A is a side view of the vehicle stacking apparatus of the present invention in a first mode of operation with both the upper and lower vehicle support platforms in a down condition.
Figure 3:
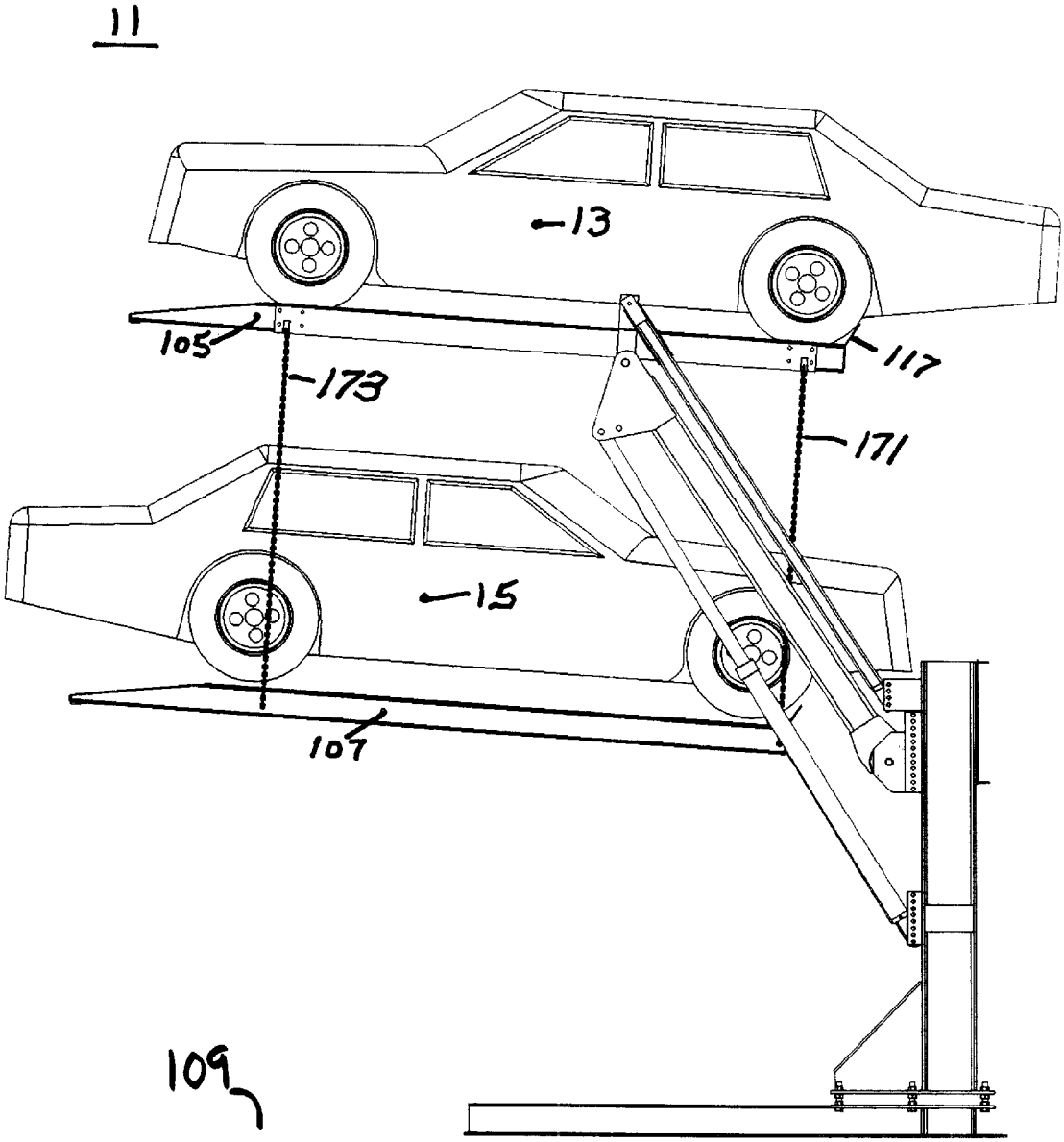
FIG. 3 is a side view of the vehicle stacking apparatus of the present invention with the upper vehicle support platform and lower vehicle support platform loaded.

FIG. 2A depicts in full detail the improved vehicle stacking system 11 of the present invention in a first vehicle loading position with both the upper and lower vehicle support platforms 105, 107 in a fully down position. FIG. 3 depicts the improved vehicle stacking system 11 of the present invention in full detail in a third loading position with the upper and lower vehicle support platforms 105, 107 in predetermined fixed positions above flooring 109, to allow the parking of a third vehicle underneath the lower vehicle support platform 107.

Returning now to FIG. 2A, the improved vehicle stacking system 11 of the present invention will now be described in detail. As is shown, upper vehicle support platform 105 and lower vehicle support platform 107 are in a fully down position proximate flooring 109 within a parking structure. While upper vehicle support platform 105 and lower vehicle support platform 107 are substantially uniform length, they are staggered in position to generally define a ramping region 111 which facilitates driving of the first vehicle onto upper vehicle support platform 105. As is shown, the front end 112 of upper vehicle support platform 105 is maintained a predetermined distance $d_1$ from the front end 114 of lower vehicle support platform 107. Furthermore, a ramping region 113 is provided in the front portion of upper vehicle support platform 105, and likewise a ramp region 115 is provided at the front region of lower vehicle support platform 107. Together, this defines a ramping region 111 which facilitates driving of the vehicle onto upper vehicle support platform 105. Furthermore, as is shown in the view of FIG. 2, upper vehicle support platform 105 is maintained at an angle alpha from lower vehicle support platform 107 which is preferably substantially flush with flooring 109. This slight downward tilting also facilitates a ramping function which allows the vehicle to be driven onto upper vehicle support platform 105. Upper vehicle platform support 105 is rigidly maintained at the angle alpha from normal by the geometry of the lifting system, which will be described in detail below. Upper and lower vehicle support platforms 105, 107 further include stops 117, 119 at the opposite ends from the ramping region 111 which serve to prevent driving or rolling of the vehicles beyond the edge of the vehicle support platforms 105, 107.

Upper vehicle support platform 105 and lower vehicle support platform 107 are raised and lowered relative to flooring 109 through lifting assembly 121. Lifting assembly 121 includes hydraulic cylinder 123, torque bar 125, and reaction arm 127. Each of these is connected in a different manner and location to vertical support member 101 at one end, and to upper vehicle support system 141 at the opposite end. Hydraulic cylinder 123 is pivotally coupled at pivotal coupling 133, through plate 131, to vertical support member 101. The utilization of plate 131 allows for adjustment in the position of the connection between hydraulic cylinder 123 and vertical support member 101 to allow for adjustments which may be necessary due to irregularities in flooring 109, such as an unlevel or uneven flooring. At the opposite end, hydraulic cylinder 123 is connected to torque bar plate 135 at pivotal coupling 137. Torque bar plate 135 is coupled at pivotal coupling 139 to a lower portion of connection plate 141 which is affixed to a side portion of upper vehicle support system 141. Torque bar 125 is coupled rigidly to torque bar plate 135. At its opposite end, torque bar 125 is coupled through mounting plate 145 to vertical support member 101 at pivotal coupling 143. Mounting plate 145 is utilized to allow adjustments in the positioning of torque bar 125. Reaction arm 127 is coupled through mounting plate 147 to vertical support member 101. At the opposite end, reaction arm 127 is coupled to an upper portion of support system 141 which is secured to the side of upper vehicle support platform 105.

Figure 2B:
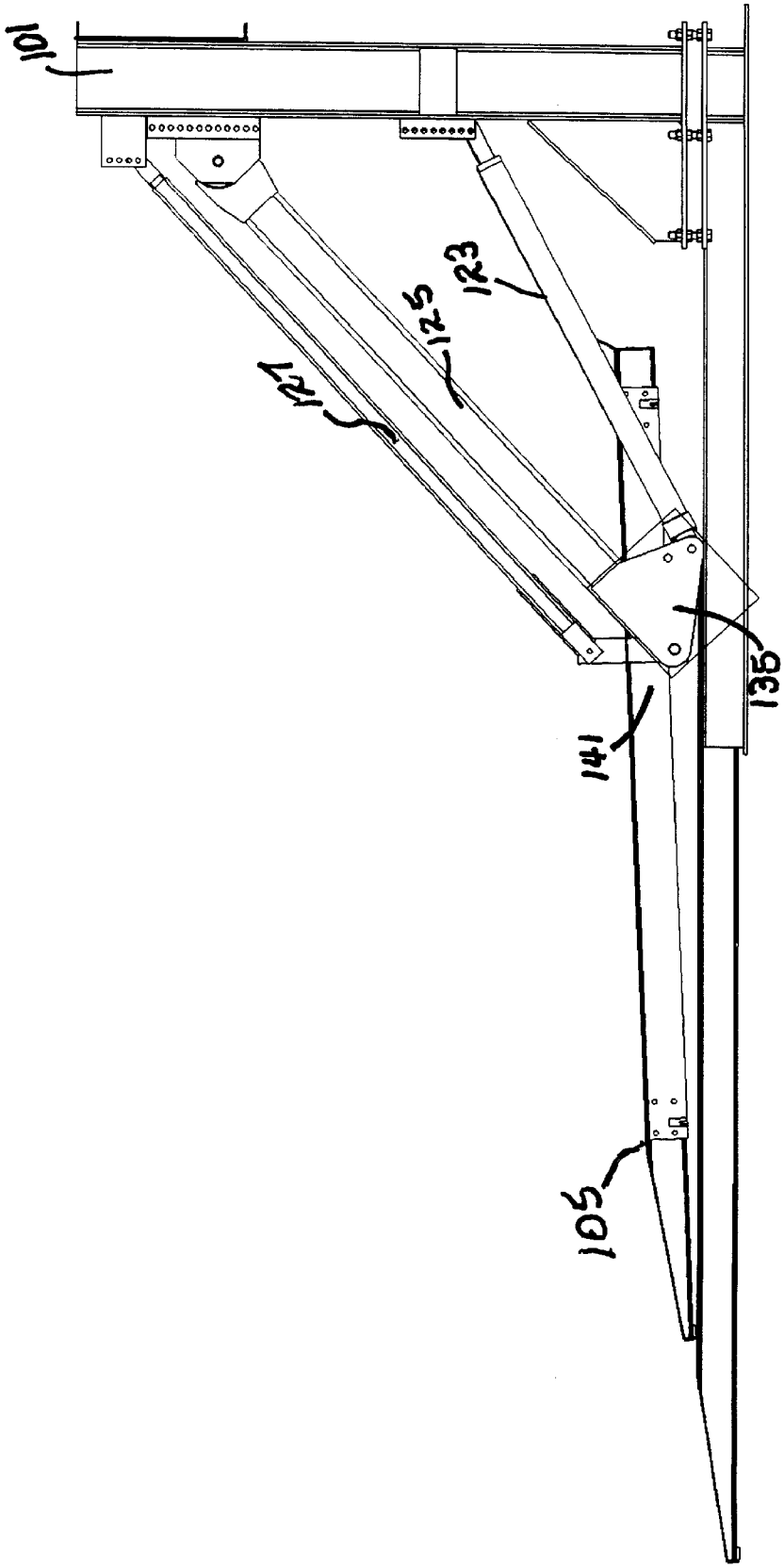
FIG. 2B is a simplified graphical depiction of the improved vehicle stacking system 11 of the present invention in a down position.

FIG. 2B is a simplified graphical depiction of the improved vehicle stacking system 11 of the present invention in a down position. As is shown, hydraulic cylinder 123, torque bar 125, and reaction arm 127 are connected between vertical support member 101 and upper vehicle support platform 105. Force F is applied through hydraulic cylinder 123 as the piston is stroked outward relative to the cylinder. This supplies force through torque bar plate 135 to lift vehicle support platform 105. In the fully down position, vehicle support platform 105 is maintained at an angle alpha relative to the flooring which helps provide a ramp for allowing the vehicles to be driven onto and off of vehicle support platform 105. As the piston of hydraulic cylinders stroked outward, the force applied to torque bar plate 135 serves to gradually rotate torque bar plate 135 counterclockwise approximately 90°.

Figure 2C:
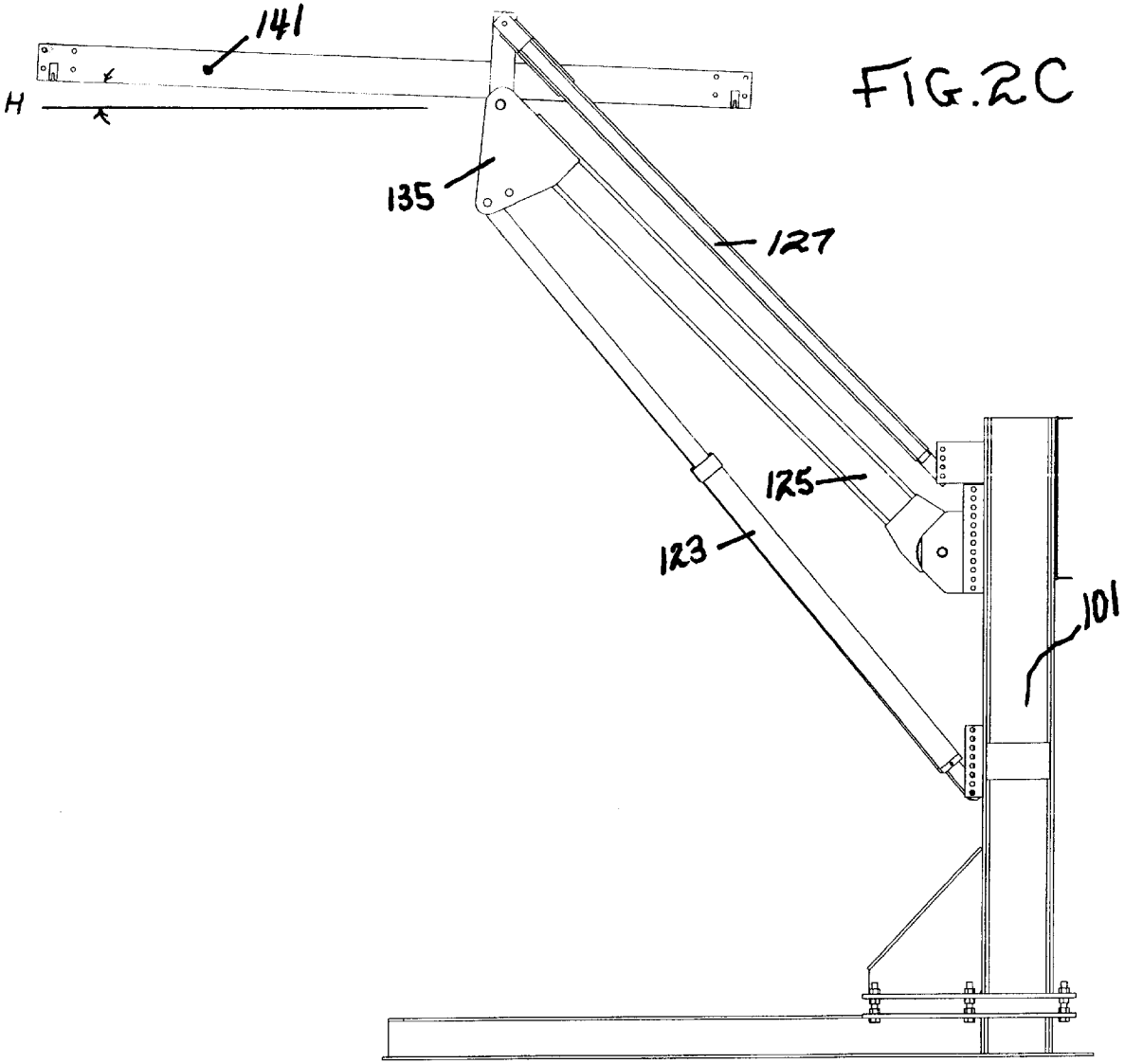
FIG. 2C is a simplified representation of the improved vehicle stacking system 11 of the present invention in a fully up position, with the piston stroke completely outward relative to the cylinder of hydraulic cylinder.

FIG. 2C is a simplified representation of the improved vehicle stacking system 11 of the present invention in a fully up position, with the piston stroked completely outward relative to the cylinder of hydraulic cylinder 123. As is shown, in the fully up position, the torque bar plate 135 has been rotated approximately 90° when the piston is fully extended. In this position, as is shown in FIG. 2C, the vehicle support platform 105 is maintained at an angle beta from an orthogonal position which maintains the vehicle support platform 105 at a slight tilt opposite from the ramping tilt in the full down position. This tilt is necessary for safety reasons to prevent the vehicle from rolling backwards off of the ramp should the brakes fail or not be applied. Recall there is a stop at one end of the vehicle support platform to prevent roll off in that direction.

When the cars are lifted and stored, the forward end of the vehicle support platform is maintained in a slightly lower position than the distal end of the vehicle support platform. Assuming that the vehicles are loaded with the front end of the vehicle toward the vertical support structure, this results in a gravity bias of the vehicle toward the vertical support structure (and associated wall) which increases safety, and reduces the risk of loss and harm, in the event that the vehicle braking system has not been properly set. Thus, if the brakes are not set, the vehicle will roll forward into contact with the stops or the wall which is utilized to support the vertical support structure at the forward end of the vehicle support platform. The vehicle will not roll backward off of the platform, thus minimizing the risk of accidents. In contrast, however, when the upper and lower vehicle support platforms are in a down loading position, the lifting apparatus maintains the forward end of the vehicle support platform slightly elevated relative to the distal end of the vehicle support platform, allowing the vehicle support platform to serve in part as a ramping structure to facilitate loading of vehicles onto the upper and lower vehicle support platforms.

This advantage is obtained by having structural components which define a generally parallelogram shape. In the preferred embodiment of the present invention, the generally parallelogram shape is defined by a torque bar, a reaction arm, and the connection points that the torque bar and reaction arm have with both the vertical support structure and the upper vehicle support platform. Preferably, the torque bar and reaction arm are of identical length. Additionally, the torque bar and reaction arm are pivotally coupled to the upper vehicle support platform a predetermined distance apart (for example, fourteen inches apart). In contrast, the torque bar and reaction arm are pivotally connected to a vertical support structure (which is preferably secured to a wall or adjoining wall) a predetermined distance which is a bit shorter than the spacing between the pivotal connections at the upper vehicle support platform (for example, thirteen inches). The slight difference in distance (for example, one inch) between the pivotal connection points results in a slight elevation of the forward end of the vehicle support platform relative to the distal end to allow loading. In contrast, during and after elevation of the vehicle support platforms, the difference in distance between the pivotal connections of the torque bar and reaction arm results in a slight lowering of the forward end of the vehicle support platform relative to the distal ends, resulting in a gravity bias of the vehicles to a forward position, enhancing safety.

Figure 9:
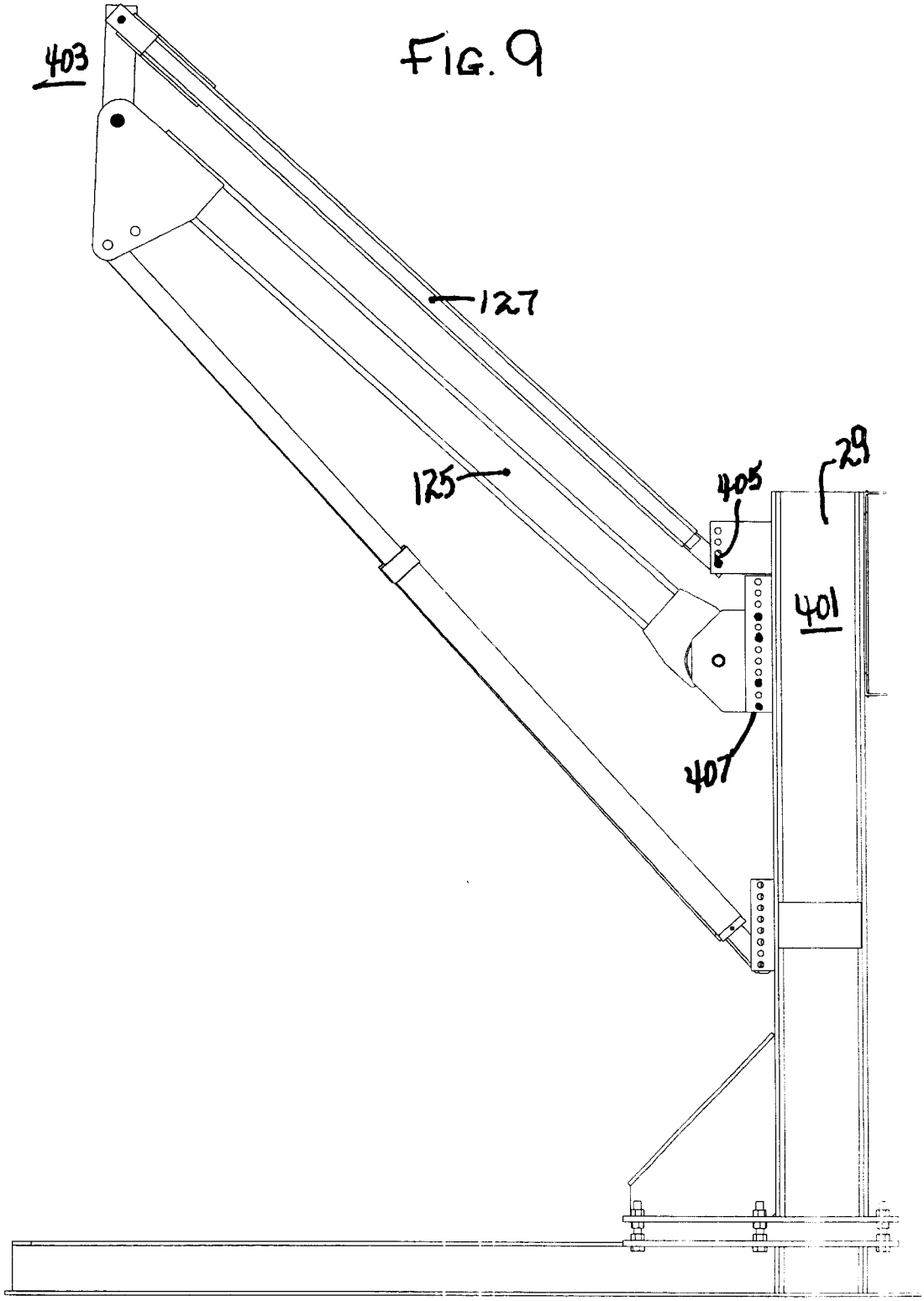
FIG. 9 is a simplified view of the generally parallelogram shape which constitutes a "four bar linkage" which tilts the upper and lower vehicle support platforms at particular angles.

FIG. 9 is a simplified pictorial representation of such a general parallelogram shape in accordance with the preferred embodiment of the present invention. As is shown, one upper edge of the parallelogram is defined by reaction arm 127. A lower edge of the parallelogram is defined by torque bar 125. As is shown, reaction arm 127 and torque bar 125 are connected to substantially vertical portions of the parallelogram including vertical segment 401 and vertical segment 403. Vertical segment 401 is determined by the particular connection point selected for pivotally connecting reaction arm 127 and torque bar 125 to the vertical support structure (29 of FIG. 1). As is shown in FIG. 1, a plurality of connection points are defined, and may be utilized to determine a particular degree of tilt provided to the upper and lower vehicle platforms when a fully up or fully down position. As is shown in the view of FIG. 9, section 401 is slightly shorter in length than section 403. Section 403 is of fixed length and is determined by the connection points for reaction arm 127 and torque bar 125 to the upper vehicle support platform 105. In the preferred embodiment of the present invention, the distance of segment 401 is approximately one inch shorter than the distance of segment 403. This means that vehicle support platform 105 will be slightly tilted in one direction when in a fully down position, while slightly tilted in the opposite direction when in an upward position. In accordance with the preferred embodiment of the present invention, the distance of segment 401 is, for example, thirteen inches, while the distance of segment 403 is, for example, fourteen inches. The difference of one inch will provide a preselected amount of tilt (typically four or five degrees of tilt is all that is required). The apparatus of the present invention is advantageous in that it allows the selection of the degree of tilt to suit a particular location. This is done during installation by selecting the connection points 405, 407 from a range of available points. For example, an operator may provide a lesser or greater amount of tilting by selecting different connection points 405, 407, from the range of available connection points, such as visually depicted in FIG. 1.

Returning now to FIG. 2A, the vertical support member 101 is coupled through adjustable fasteners 151, 153, 155 to horizontal support member 103. In the preferred embodiment of the present invention, the vertical horizontal support members are positioned both to the left and to the right of the parked vehicles. The other half of the apparatus is obscured in the view of FIG. 2A, and since the apparatus is symmetrical about a central line, it is not necessary to depict the opposite side of the improved vehicle stacking system 11 of the present invention.

Turning now to FIG. 3, the improved vehicle stacking system 11 of the present invention is depicted in a fully up, partially loaded condition. As is shown, vehicle 13 is carried on upper vehicle support platform 105, which is maintained at an angle beta from normal, with the front wheels of the vehicle resting upon the stop 117. Lower vehicle support platform 107 is suspended by collapsible linkage connection such as chains 171, 173 (and two other chains which are not depicted in this view). One advantage of the present invention is that, since the upper and lower vehicle platforms 105, 107 are moved through an arc as the device is raised and lowered, the chains will be laid out over the length of the arc I (which is depicted in FIG. 1), which prevents the chains from balling up and becoming tangled. This ensures safer and smoother operation of the improved vehicle stacking system 11.

Figure 4A:
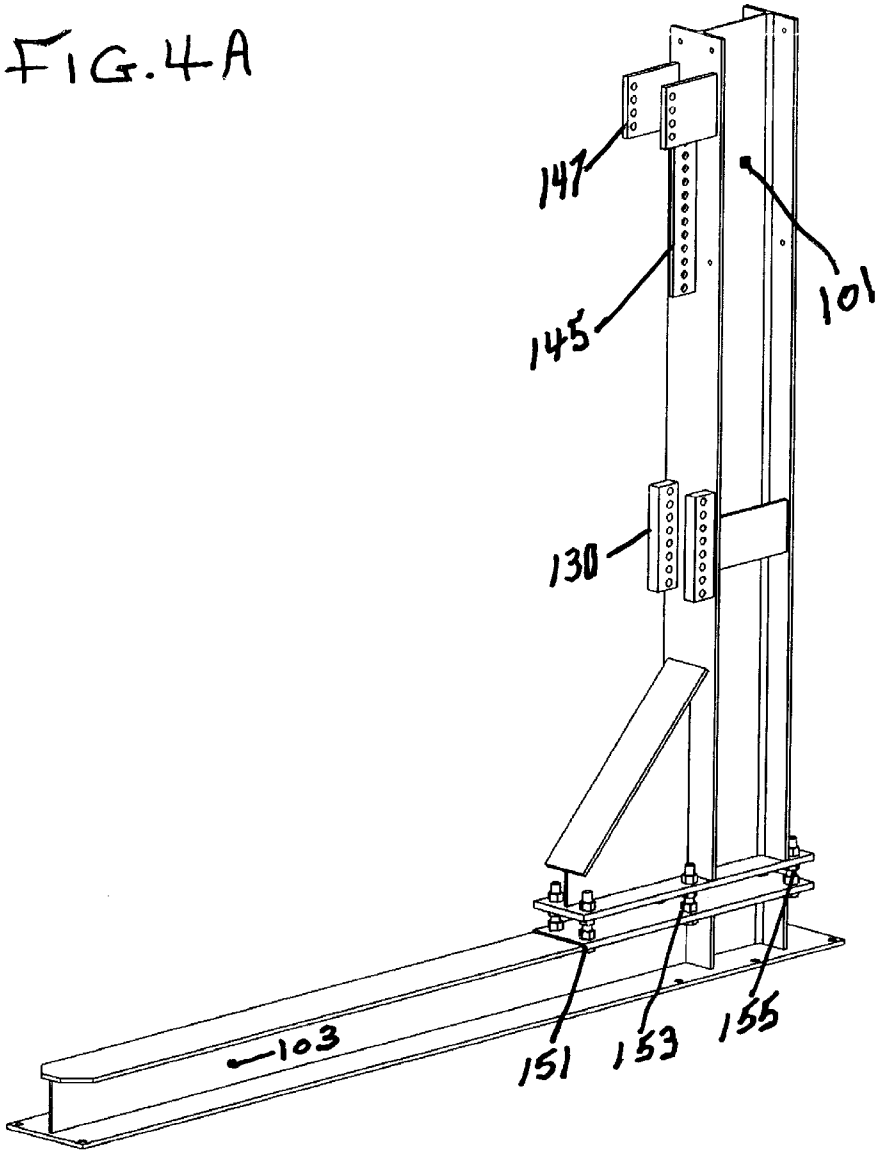
FIGS. 4*a* and FIGS. 4*b* are side view of the vertical support leg member utilized in the preferred embodiment of the present invention.
Figure 4B:
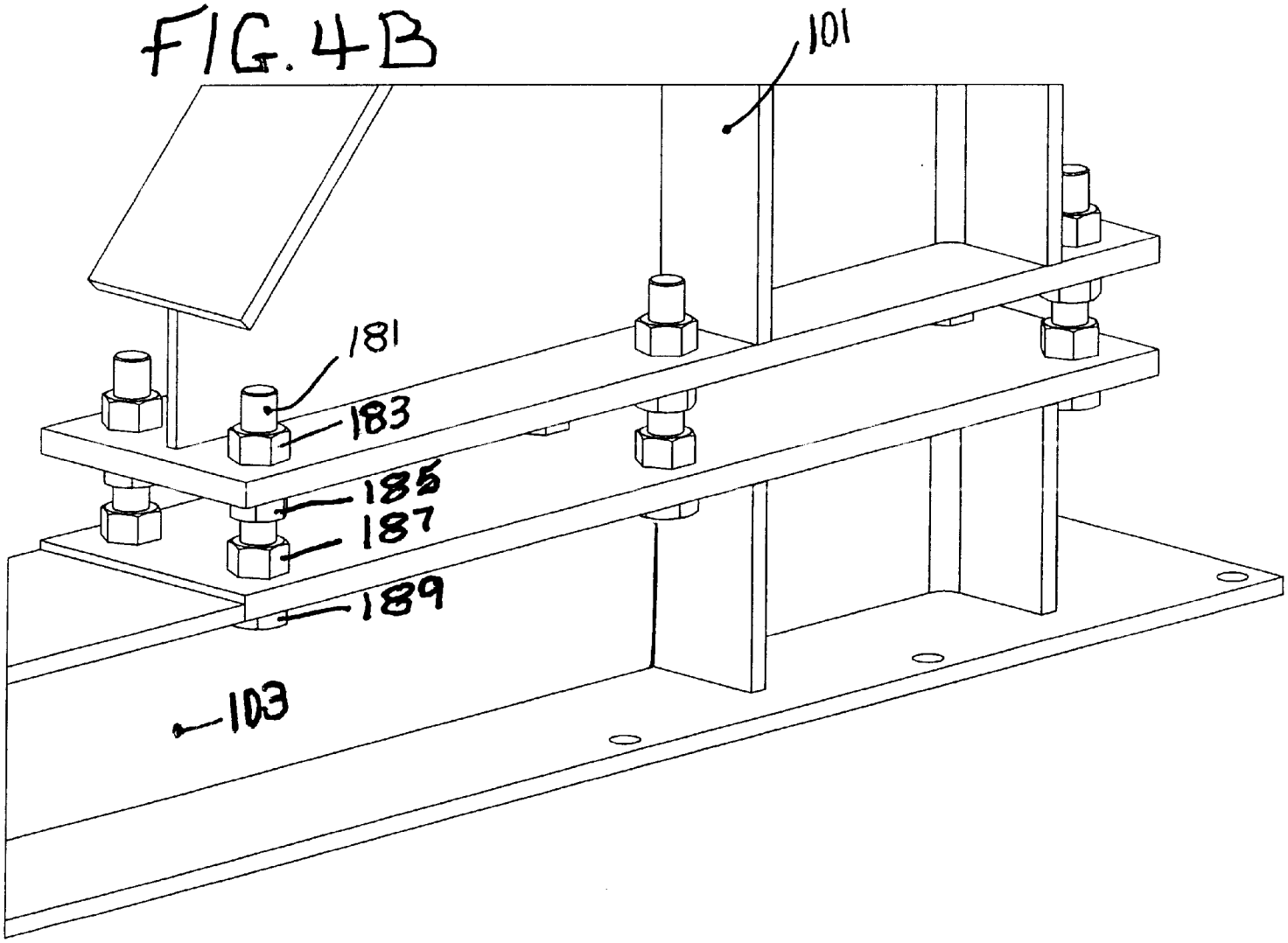

FIGS. 4*a* and FIGS 4*b* are a side view of the vertical support member 101. As is shown, mounting plates 147, 145, 130 are provided with a plurality of connection ports formed therein which allow for the relative upward and downward positioning of the reaction arm 127, the torque bar 125, and the hydraulic cylinder 123 (all of FIG. 2A). This allows the installer to take into consideration irregular geometries and sloping surfaces in a particular parking structure. Additional adjustment is allowed by the fasteners 151, 153, 155 of FIG. 2A. Fastener 151 is depicted in greater detail in FIGS. 4*a* and 4*b* As is shown, a threaded bolt 181 is provided to extend through ports provided in the vertical support member 101 and the horizontal support member 103. Nuts 183, 185, 187, and 189 are provided to allow the mechanical coupling between the vertical support member 101 and the horizontal support member 103, but which allows for adjustment in the relative position between the vertical support member 101 and the horizontal support member 103.

Figure 5A:
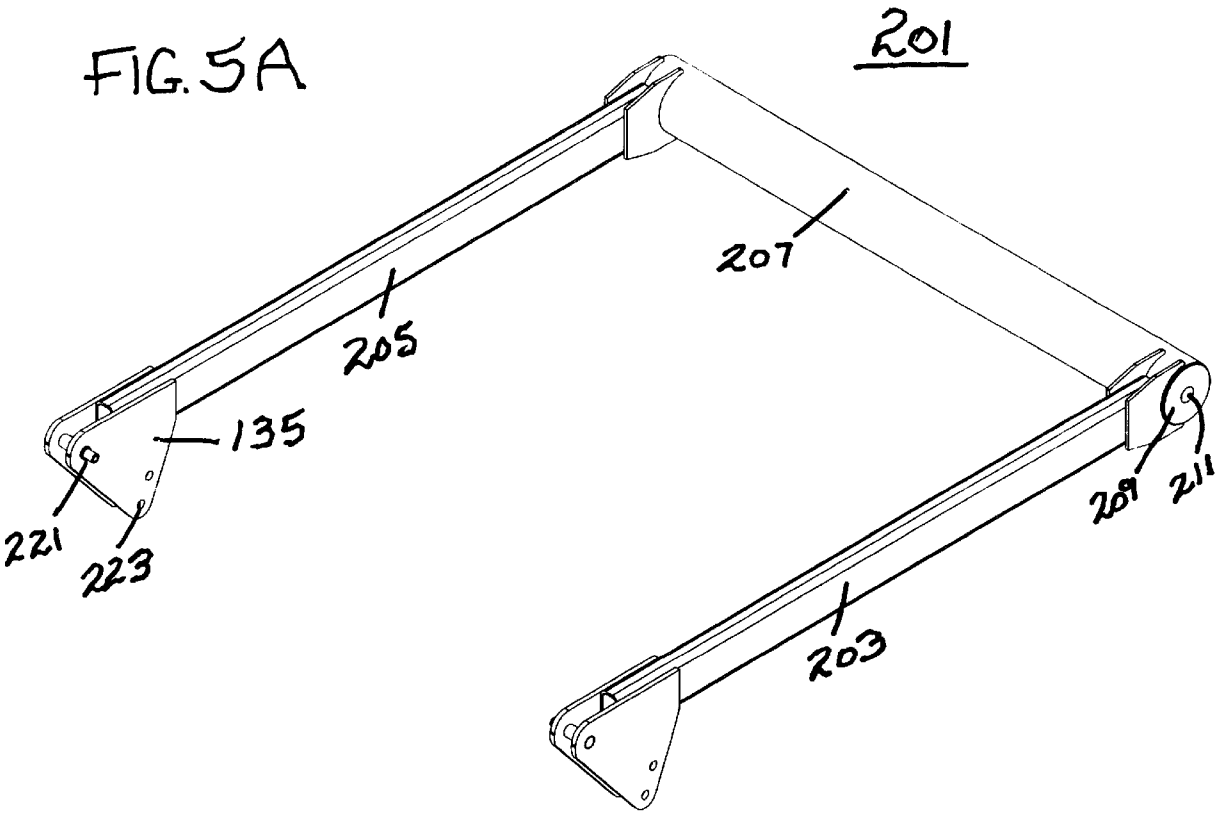
FIGS. 5A and 5B are top plan views of the torque bar and cradle arms of the preferred embodiment of the vehicle stacking apparatus of the present invention.
Figure 5B:
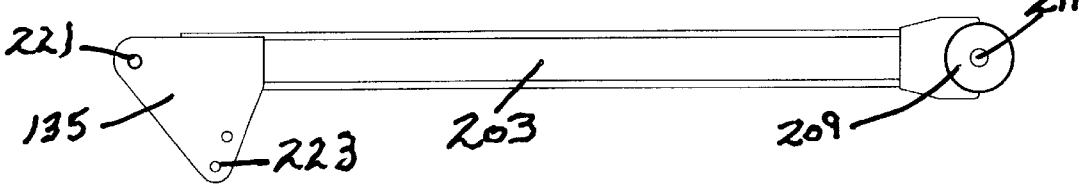

Turning now to FIGS. 5A and 5B, there is depicted the torque bar assembly 201. FIG. 5A is a top view of the torque bar in accordance with the preferred embodiment of the present invention. As is shown, torque bar assembly 201 includes a tubular center member 207 which is rigidly coupled to extender members 203, 205. The tubular center member 207 is equipped with ports 209, 211 which are adapted for pivotal coupling with vertical support member 101 (not depicted). FIG. 5B is a side view of the device shown in FIG. 5A, which depicts tubular center member 209 with center cavity 211, and extender member 205. As is shown, the extender member 205 terminates at torque plate 135 which includes ports 221, 223 which are adapted for pivotally connecting to the hydraulic cylinder and to the upper vehicle support platform 105 (not depicted in this figure).

Figure 6:
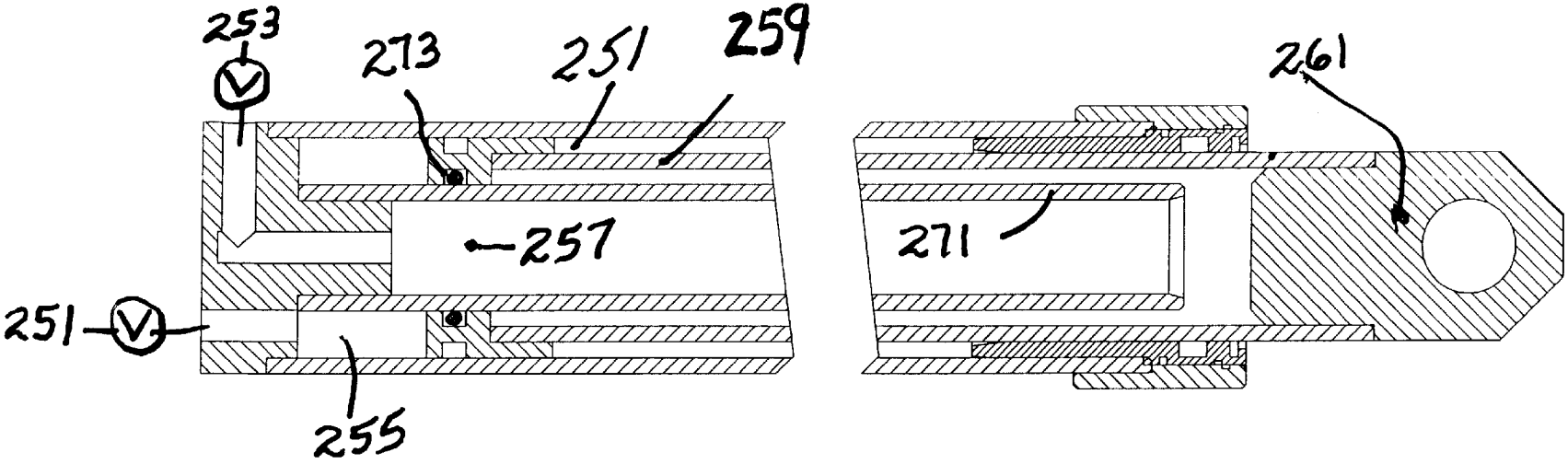
FIG. 6 is a longitudinal section view of the preferred lift cylinder utilized in the preferred embodiment of the vehicle stacking apparatus of the present invention.

FIG. 6 is a longitudinal section view of the preferred hydraulic cylinder in accordance with the preferred embodiment of the present invention. The hydraulic cylinder 123 is unique in that it includes two independently operable cylinder cavities which together work against a movable piston member. As is shown, piston member 261 fits within concentrically nested tubular which define two separate cavities for receipt of high pressure hydraulic fluid. In the view of FIG. 6, cavity 255 receives high pressure hydraulic fluid through piloted, soft seat check valve 251, while cavity 257 receives high pressure hydraulic fluid through piloted, soft seat check valve 253. The cavity 257 allows fluid to flow in and around tubular 271. Seal assembly 273 separates the fluid from cavity 257 from the fluid containing cavity 255. The pressure cavities work in opposition. As fluid is filling fluid cavity 255, sleeve is urged outward relative to sleeve 271. Expansion of cavity 255 results in a corresponding increase in the cavity size of cavity 257. If either check valve 251 or check valve 253 fails, the other cavity is sufficient to hold piston member 261 in its position at the time of the failure.

Figure 7:
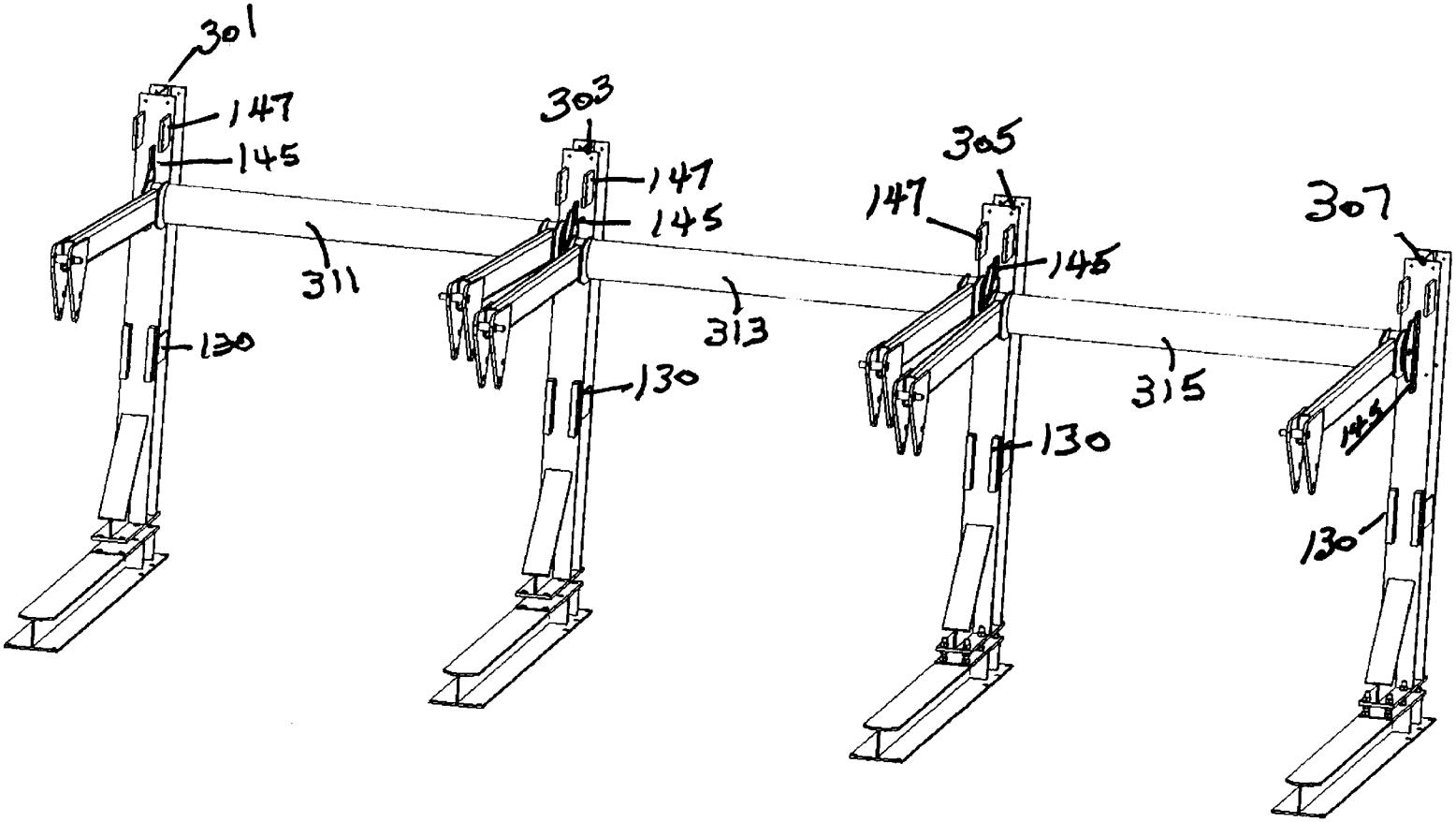
FIGS. 7 and 8 are depictions of the "ganging" of the lift system of the present invention in order to accommodate sloped flooring, and to maximize the use of parking space.

The improved vehicle stacking system of the present invention is modular by design to allow utilization of the system in a variety of situations, including unlevel ground. This concept is depicted in FIG. 7, wherein vertical support members 301, 303, 305, 307 are shown in position relative to sloped flooring 309. The adjustability (including the plurality of connection ports shown in mounting pieces 147, 145, 130 of FIG. 4) allow the vertical support members to be positioned on slope flooring 309 yet maintain relatively rectilinear orientation of the lifting components, as is shown by the horizontal bars 311, 313, 315.

Figure 8:
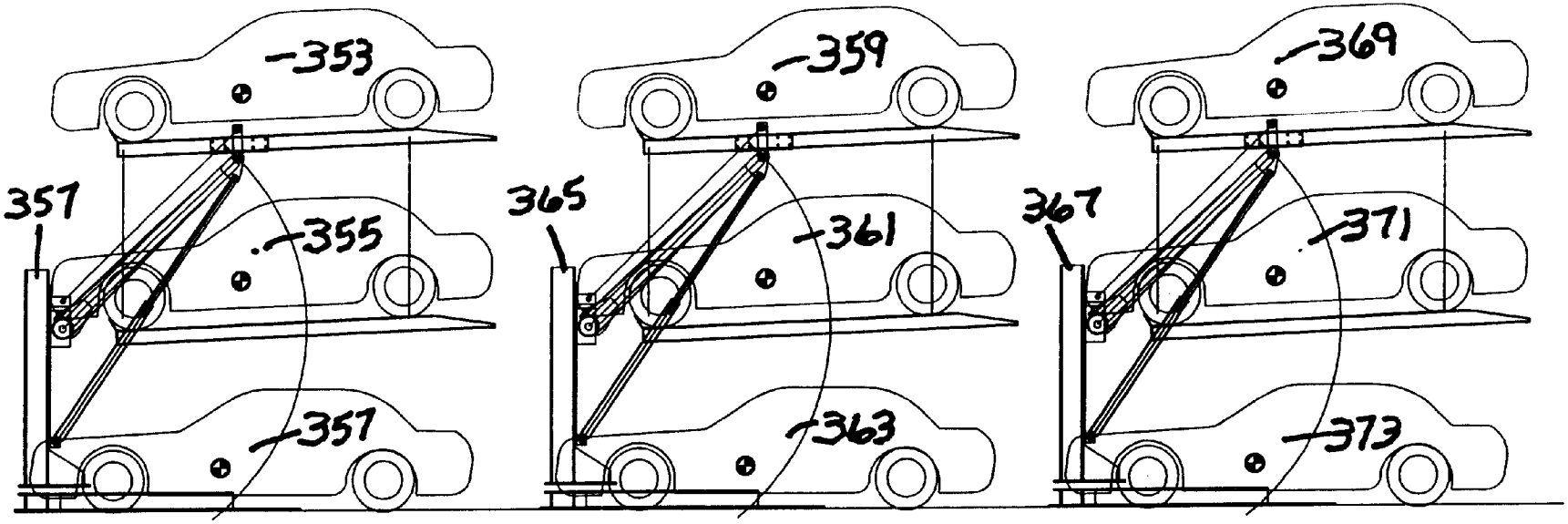

While the "ganging" of the modular units is depicted for side-by-side positioning in FIG. 7, FIG. 8, in contrast, depicts the "ganging" of the units end-to-end as is shown in FIG. 8. In the view of FIG. 8, vehicle staking apparatus 357 is positioned adjacent vehicle stacking apparatus 365 which is adjacent vehicle stacking apparatus 367. As is shown, vehicle stacking apparatus 357 stores vehicles 353, 355, 357. Vehicle stacking apparatus 355 stores vehicles 359, 361, 363. Vehicle stacking apparatus 367 stores vehicles 369, 371, 373. When "ganged" in this manner, vehicles 369, 371 of stacking apparatus 367 must be loaded first. Then, vehicles 359, 361 must be loaded next, followed by vehicles 353, 355. Then vehicles 357, 363, and 373 are loaded in that order. This ordering is due to the presence of the "stops" on the upper and lower vehicle platforms.

Another advantageous feature of the present invention is the structure of the upper vehicle support platform. In the preferred embodiment, the upper vehicle support platform is made up of a platform cradle which is composed of a plurality of load bearing members, including a pair of elongated parallel side support members which are substantially parallel to the longitudinal axis of a vehicle positioned with the apparatus. Additionally, the upper vehicle support platform includes a platform member which is adapted in length and width to receive and support a vehicle. Preferably, the platform member includes a lower cavity which is adapted to mechanically mate with the platform cradle. In other words, the platform member is strong enough to support a vehicle, but need not be strong enough to support the platform and vehicle which are suspended thereunder. The platform cradle is the load bearing structure which supports the weight of the platform member (and the vehicle located thereon) as well as the weight of the lower vehicle support platform (and the vehicle located thereon). In accordance with this embodiment, the lower vehicle support platform is coupled to the platform cradle utilizing a collapsible connection. In the preferred embodiment, the collapsible connection comprises a plurality of chain members which extend from the lower vehicle support platform to the platform cradle. The advantage of this construction is that the function which must be performed by the platform member (supporting a vehicle) can be separated from the function of the platform cradle, which is supporting at least twice that weight, since it supports the lower vehicle support platform and vehicle in addition to the platform member. This is advantageous since the apparatus can be substantially constructed before requiring the placement of the platform member on the platform cradle. In the preferred embodiment, the platform member includes a lower cavity which mechanically mates on top of the platform cradle. Typically, the cavity is generally rectangular, so the platform member may be formed from flat sheets of metal with orthogonal side portions which extend down around the platform cradle. The platform member can be lifted into position utilizing a forklift or other lifting equipment. However, the storing apparatus can be substantially constructed without requiring the placement of the platform member into position. Once the upper vehicle support platform is constructed, the collapsible connection (preferably chains) can be utilized to secure the lower vehicle support platform to the platform cradle.

Figure 10:
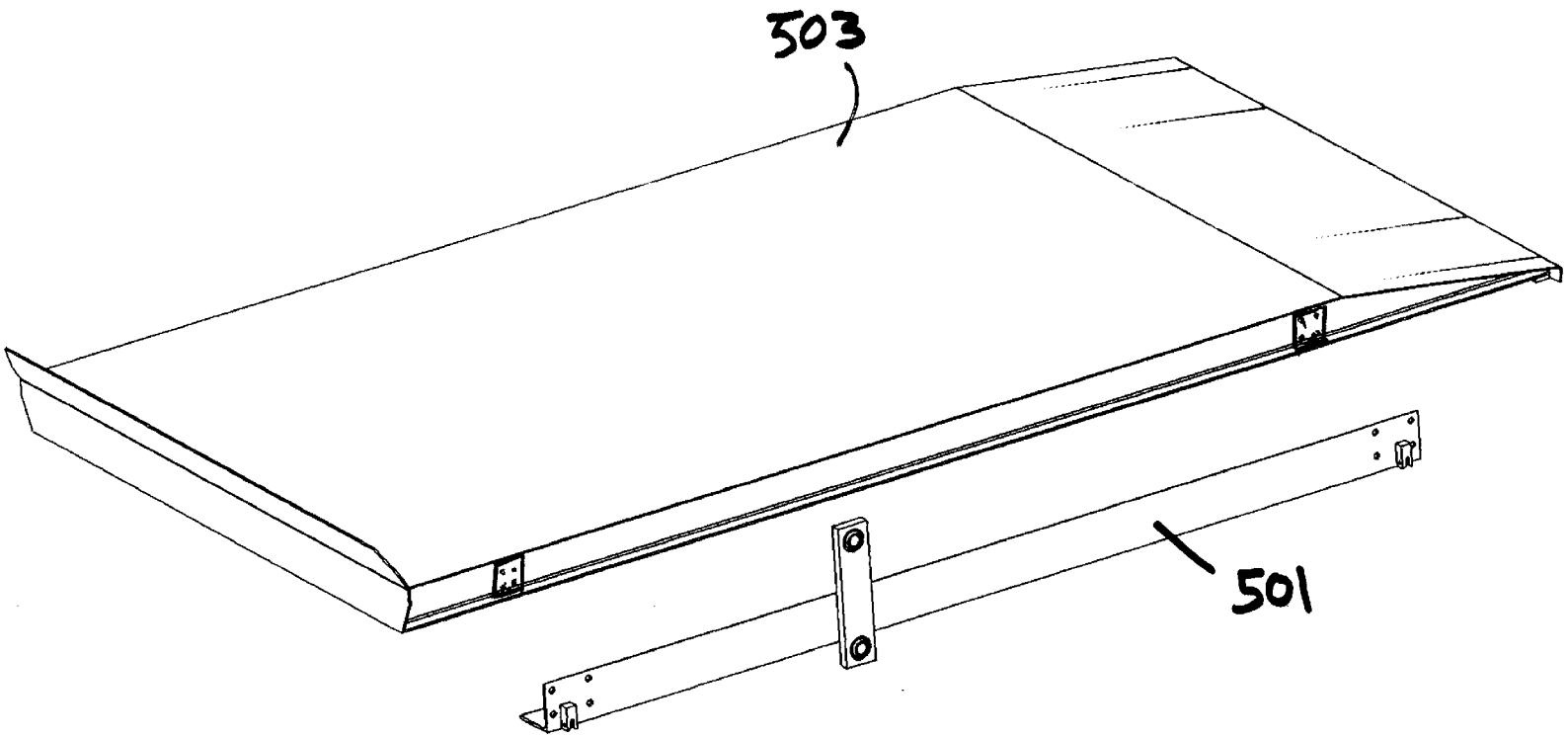
FIG. 10 is a depiction of the platform cradle and platform member in accordance with one preferred embodiment.

FIG. 10 is a pictorial representation of a platform cradle 501 and platform member 503 separated from one another, and then joined with one another. In accordance with the preferred embodiment of the present invention, platform cradle 501 is a load bearing structure which is composed of a plurality of vertical and horizontal members, including two parallel side rail members (only one is shown in the view of FIG. 10) and a plurality of cross members securing the two together. This structure is a load bearing structure which is adapted to carry the load of the weight of platform 503 (and the vehicle located thereon) as well as the load of the lower vehicle support platform which is suspended therefrom by chains or other collapsible linkage members. As is shown in the view of FIG. 10, platform 503 includes a lower cavity 507 which is adapted in size and shape to mate over platform cradle 501. Also, as is shown in FIG. 10, this system is advantageous since it allows the multi-car parking apparatus to be assembled substantially entirely before the platform member 503 is placed into position. It may be located into position utilizing a forklift or other lifting device. Platform 503 need only be strong enough to support the weight of the vehicle which is supported on it. In contrast, platform cradle 501 has to be strong enough to support platform 503, the vehicle on it, the lower vehicle support platform and the vehicle which is carried on it. In other words, the structural integrity of platform cradle 501 is critical to the entire operation of the apparatus, and platform 503, in contrast, may be a substantially lighter economical construction. The result of this design is a decrease in the overall weight of the vehicle support platforms which is substantial. The upper and lower vehicle support platforms need only be strong enough to support the vehicle, resulting in a decrease in weight of approximately five hundred pounds apiece, in a typical installation. Accordingly, over one thousand pounds of weight is eliminated through this design. The load bearing platform cradle 501 has to be strong enough to support and lift the vehicles, but it is generally skeletal in construction and composed of a number of loading bearing beams which are formed in a generally rectangular shape.

The present invention includes another novel feature which is advantageous over the prior art. In accordance with the preferred embodiment, in the down position, the upper vehicle support platform is located directly above the lower vehicle support platform. In fact, it is at rest upon the lower vehicle support platform. In this mode of operation, the upper and lower vehicle support platforms are staggered into position relative to one another. Additionally, the distal ends of the upper and lower vehicle support platforms are slightly inclined. The combination of inclined distal ends which are slightly staggered in position results in the upper and lower vehicle support platforms collectively defining a ramping structure which facilitates the loading of a vehicle onto the upper vehicle support platform. When the upper vehicle support platform is moved upward, the inclined distal end of the lower vehicle support platform defines a shorter ramping structure which facilitates the loading of a vehicle onto the lower vehicle support platform.

In accordance with the preferred embodiment of the present invention, relatively conventional hydraulic control circuits are utilized to allow the raising and lowering of the vehicle support platforms. Preferably, position sensors may be placed on various components of the lifting system in order to determine electrically the desired distances between the upper and lower vehicle platforms and the flooring.

What is claimed is:

1. An apparatus for storing vehicles, comprising:

(a) a vertical support structure;

(b) a horizontal support structure mechanically coupled to said vertical support structure;

(c) a plurality of vehicle support platforms, including at least an upper vehicle support platform and a lower vehicle support platform;

(d) at least one lift arm pivotally coupled between said vertical support structure and to said upper vehicle support platform;

(e) a collapsible linkage connection between said upper vehicle support platform and said lower vehicle support platform;

(f) wherein said lower vehicle support platform is suspendable below said upper vehicle support platform by said collapsible linkage connection;

(g) a control system for operating said at least one lift arm, in order to move said apparatus between the following modes of operation:

(1) a first vehicle loading position, wherein said upper vehicle support platform and said lower vehicle support platform are in a down position with said upper vehicle support platform directly above said lower vehicle support platform;

(2) a second vehicle loading position, wherein said upper vehicle support platform is elevated a predetermined distance above said lower vehicle support platform, but with said lower vehicle support platform in a down position substantially in engagement with a flooring; and (3) a third vehicle loading position, wherein said upper vehicle support platform and said lower vehicle support platform are disposed predetermined distances above said flooring with said lower vehicle support platform suspended from said upper vehicle support platform by said collapsible linkage connection.

2. An apparatus for storing vehicles according to claim 1, wherein said collapsible linkage connection comprises a plurality of chains connecting said upper and lower vehicle support platforms together.

3. An apparatus for storing vehicles according to claim 1, wherein said collapsible linkage connection comprises symmetrically positioned collapsible linkage members connecting said upper and lower vehicle support platforms together.

4. An apparatus for storing vehicles according to claim 1, wherein said collapsible linkage connection comprises symmetrically positioned chains connecting said upper and lower vehicle support platforms together.

5. An apparatus for storing vehicles according to claim 1, further comprising:

(h) a reaction arm pivotally coupled between said vertical support structure and said upper vehicle support platform.

6. An apparatus according to claim 5, wherein said reaction arm and said at least one lift arm move through a predefined arc extending through said first vehicle loading position, said second vehicle loading position, and said third vehicle loading position.

7. An apparatus according to claim 1, wherein said plurality of vehicle support platforms are of substantially uniform length.

8. An apparatus according to claim 1, wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

9. An apparatus according to claim 1, wherein, during movement between said second loading position and said first loading position, said collapsible linkage connection is laid flat on said flooring thus minimizing the possibility of entanglement thereof.

10. An apparatus according to claim 1, wherein, during movement between said first loading position and said second loading position, said collapsible linkage connection is pulled upward as said upper vehicle support platform ascends relative to said flooring.

11. An apparatus for storing vehicles, comprising:

(a) a vertical support structure;

(b) a plurality of vehicle support platforms, including an upper vehicle support platform and a lower vehicle support platform;

(c) at least one adjustable-length lift arm pivotally coupled between said vertical support structure and to said upper vehicle support platform;

(d) a reaction arm pivotally coupled between said vertical support structure and said upper vehicle support platform;

(e) a rotatable connection member pivotally connecting said at least one adjustable-length lift arm and said reaction arm to said upper vehicle support platform;

(f) a collapsible connection between said upper vehicle support platform and said lower vehicle support platform;

(g) a control system for operating said at least one adjustable-length lift arm, in order to move said apparatus between the following modes of operation:

(1) a first vehicle loading position, wherein said upper vehicle support platform and said lower vehicle support platform are in a down position with said upper vehicle support platform directly on top of said lower vehicle support platform;

(2) a second vehicle loading position, wherein said upper vehicle support platform is elevated a predetermined distance above said lower vehicle support platform, but with said second vehicle support platform in a down position substantially in engagement with a flooring; and (3) a third vehicle loading position, wherein said first vehicle support platform and second vehicle support platform are disposed predetermined distances above said flooring.

12. An apparatus according to claim 11, further comprising:

(h) a torque bar coupled between said vertical support structure and said upper vehicle support platform.

13. An apparatus according to claim 11, further comprising:

(h) wherein said rotatable connection member is moved generally through a predetermined arc pathway as said apparatus is moved between said modes of operation.

14. An apparatus according to claim 11, wherein inward and outward movement of said at least one adjustable-length lift arm relative to said vertical support structure rotates said rotatable connection member relative to said upper vehicle support platform.

15. An apparatus according to claim 11, wherein, during operation, said reaction arm and said at least one adjustable-length lift arm move through a predefined arc extending through said first vehicle loading position, said second vehicle loading position, and said third vehicle loading position.

16. An apparatus according to claim 11, wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

17. An apparatus according to claim 11, wherein said collapsible linkage member comprises a plurality of chains extending between said upper vehicle support platform and said lower vehicle support platform.

18. An apparatus according to claim 11:

wherein a parallelogram defined by said vertical support structure, said reaction arm, said torque bar, and connections to said rotatable connection member determines an angle of tilt for said upper and lower vehicle support platforms; and wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

19. An apparatus for storing vehicles according to claim 11, wherein said upper vehicle support platform comprises:

a platform cradle composed of a plurality of load bearing members including a pair of elongated parallel side support members;

a platform member adapted in length and width to receive and support a vehicle, and including a lower cavity which is adapted to mechanically mate with said platform cradle.

20. An apparatus for storing vehicles according to claim 19:

wherein said rotatable connection member comprises:

a pair of plates adapted for pivotal connection to said pair of elongated parallel side support members of said platform cradle.

21. An apparatus for storing vehicles, comprising:

(a) a vertical support structure;

(b) a vehicle support platform;

(c) at least one adjustable-length lift arm pivotally coupled between said vertical support structure and to said vehicle support platform;

(d) a reaction arm pivotally coupled between said vertical support structure and said vehicle support platform;

(e) a torque bar coupled between said vertical support structure and said vehicle support platform;

(f) a rotatable connection member pivotally connecting said at least one adjustable-length lift arm and said reaction arm to said vehicle support platform;

(g) a control system for operating said at least one adjustable-length lift arm, in order to move said apparatus between the following modes of operation:

(1) a down position, wherein said vehicle support platform is in a down position adjacent a flooring;

(2) an up position, wherein said vehicle support platform is in an up position elevated a predetermined distance above said flooring;

(h) wherein said vertical support structure, said torque bar, said reaction arm, a separation in distance between connection points for said reaction arm and said vehicle support platform along said vertical support structure, and a separation in distance between connection points for said torque bar and said vertical support platform at said vehicle support platform collectively define a generally parallelogram shape; and (i) wherein differences in length of two vertical portions of said generally parallelogram shape cause a distal end of said vehicle support platform to be tilted downward at a predetermined angle relative to said flooring in order to facilitate loading of a vehicle onto said vehicle support platform when it is in said down position, and also cause said distal end of said vehicle support platform to be tilted in an opposite direction during a lifting of said vehicle support platform between said down position and said up position in order to gravity-bias said vehicle forwardly toward said vertical support structure.

22. An apparatus according to claim 21, further comprising:

(j) wherein a distance between pivotal connection points for said torque bar and reaction arm is shorter along said vertical support structure than at said vehicle support platform.

23. An apparatus according to claim 21, further comprising:

(j) wherein said rotatable connection member is moved generally through a predetermined arc pathway as said apparatus is moved between said down position and said up position.

24. An apparatus according to claim 21, wherein, during operation, said reaction arm and said at least one adjustable-length lift arm move through a predefined arc extending through said down position and said up position.

25. An apparatus according to claim 21, wherein, in said down position, said vehicle support platform is tilted at a predetermined angle relative to said flooring, and wherein, in said up position said vehicle support platform is tilted in a particular position relative to said flooring which is opposite from the tilt during said down position.

26. An apparatus according to claim 21:

wherein, in said down position, said vehicle support platform is tilted at a predetermined angle relative to said flooring, and wherein, in said up position, said vehicle support platforms are tilted in a particular angular position relative to said flooring which is opposite from the tilt of said down position but generally comparable in magnitude.

27. An apparatus according to claim 21, wherein, said at least one adjustable-length lift arm comprises a hydraulic cylinder.

28. An apparatus for storing vehicles according to claim 21, wherein said vehicle support platform comprises:

a platform cradle composed of a plurality of load bearing members including a pair of elongated parallel side support members;

a platform member adapted in length and width to receive and support a vehicle, and including a lower cavity which is adapted to mechanically mate with said platform cradle.

29. An apparatus for storing vehicles according to claim 28 wherein said rotatable connection member comprises:

a pair of plates adapted for pivotal connection to said pair of elongated parallel side support members of said platform cradle.

30. An apparatus according to claim 21, further comprising:

(j) a second vehicle support platform;

(k) a collapsible connection for suspending said second vehicle support platform from said vehicle support platform.

31. An apparatus for storing vehicles, comprising:

(a) a vertical support structure;

(b) upper vehicle support platform which includes:

a platform cradle composed of a plurality of load bearing members including a pair of elongated parallel side support members;

a platform member adapted in length and width to receive and support a vehicle, and including a lower cavity which is adapted to mechanically mate with said platform cradle;

(c) a pair of parallel adjustable-length lift arms pivotally coupled between said vertical support structure and to said platform cradle of said upper vehicle support platform;

(d) a pair of parallel reaction arms pivotally coupled between said vertical support structure and said platform cradle of said upper vehicle support platform;

(e) a pair of rotatable connection plates adapted for pivotal connection to said pair of elongated parallel side support members of said platform cradle, with each plate pivotally coupling a side support member to both a reaction arm and an adjustable-length lift arm;

(f) a lower vehicle support platform;

(g) a collapsible connection between said platform cradle and said lower vehicle support platform;

(h) a control system for operating said a pair of adjustable-length lift arms, in order to move said apparatus between the following modes of operation:

(1) a first loading position, wherein said upper vehicle support platform and said lower vehicle support platform are in a down position with said upper vehicle support platform directly on top of said lower vehicle support platform;

(2) a second vehicle loading position, wherein said upper vehicle support platform is elevated a predetermined distance above said lower vehicle support platform, but with said second vehicle support platform in a down position substantially in engagement with a flooring; and (3) a third vehicle loading position, wherein said first vehicle support platform and second vehicle support platform are disposed predetermined distances above said flooring.

32. An apparatus according to claim 31, further comprising:

(i) a torque bar coupled between said vertical support structure and said upper vehicle support platform.

33. An apparatus according to claim 31, further comprising:

(i) wherein said platform cradle is moved generally through a predetermined arc pathway as said apparatus is moved between said modes of operation.

34. An apparatus according to claim 31, wherein inward and outward movement of said pair of parallel adjustable-length lift arms relative to said vertical support structure rotates said pair of rotatable connection plates relative to said platform cradle.

35. An apparatus according to claim 31, wherein, during operation, said pair of parallel reaction arm and said pair of parallel adjustable-length lift arms move through a predefined arc extending through said first vehicle loading position, said second vehicle loading position, and said third vehicle loading position.

36. An apparatus according to claim 31, wherein, in said first vehicle loading position, said platform cradle is tilted at a predetermined angle relative to said flooring, and wherein, in said second and third vehicle loading positions said upper and lower vehicle support platforms are tilted in a particular position relative to said flooring which is opposite from the tilt of said first position.

37. An apparatus according to claim 31, wherein said collapsible linkage member comprises a plurality of chains extending between said platform cradle and said lower vehicle support platform.

38. An apparatus according to claim 31:

wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

39. An apparatus according to claim 31, wherein, during movement between said second loading position and said first loading position, said collapsible linkage connection is laid flat on said flooring thus minimizing the possibility of entanglement thereof.

40. An apparatus according to claim 31, wherein, during movement between said first loading position and said second loading position, said collapsible linkage connection is pulled upward as said upper vehicle support platform ascends relative to said flooring.

41. An apparatus for storing vehicles, comprising:

(a) a vertical support structure;

(b) a plurality of vehicle support platforms, including an upper vehicle support platform and a lower vehicle support platform;

(c) wherein said upper and lower vehicle support platforms include a substantially flat platform portion, and an inclined distal end portion;

(d) at least one adjustable-length lift arm pivotally coupled between said vertical support structure and to said upper vehicle support platform;

(e) a reaction arm pivotally coupled between said vertical support structure and said upper vehicle support platform;

(f) a rotatable connection member pivotally connecting said at least one adjustable-length lift arm and said reaction arm to said upper vehicle support platform;

(g) a collapsible connection between said upper vehicle support platform and said lower vehicle support platform;

(h) a control system for operating said at least one adjustable-length lift arm, in order to move said apparatus between the following modes of operation:

(1) a first loading position, wherein said upper vehicle support platform and said lower vehicle support platform are in a down position with said upper vehicle support platform directly on top of said lower vehicle support platform;

(2) a second vehicle loading position, wherein said upper vehicle support platform is elevated a predetermined distance above said lower vehicle support platform, but with said second vehicle support platform in a down position substantially in engagement with a flooring;

(3) a third vehicle loading position, wherein said first vehicle support platform and second vehicle support platform are disposed predetermined distances above said flooring; and (i) wherein, in said first loading position, said upper and lower vehicle support platforms are staggered in position relative to one another, thus locating said inclined distal end portions proximate to one another, allowing said inclined distal end portions of said upper and lower vehicle support platforms to collectively define a ramping structure facilitating the loading of a vehicle onto said upper vehicle support platform; and (j) wherein, in said second vehicle loading position, said inclined distal end of said lower vehicle support platform defines a ramping structure facilitating the loading of a vehicle onto said lower vehicle support platform.

42. An apparatus according to claim 41, further comprising:

(k) a torque bar coupled between said vertical support structure and said upper vehicle support platform.

43. An apparatus according to claim 41, further comprising:

(k) wherein said rotatable connection member is moved generally through a predetermined arc pathway as said apparatus is moved between said modes of operation, allowing said upper and lower vehicle support platforms to be staggered in said first vehicle loading position, and allowing said upper and lower vehicle support platforms to be substantially aligned in said second and third vehicle loading positions.

44. An apparatus according to claim 41, wherein inward and outward movement of said at least one adjustable-length lift arm relative to said vertical support structure rotates said rotatable connection member relative to said upper vehicle support platform.

45. An apparatus according to claim 41, wherein, during operation, said reaction arm and said at least one adjustable-length lift arm move through a predefined arc extending through said first vehicle loading position, said second vehicle loading position, and said third vehicle loading position.

46. An apparatus according to claim 41, wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

47. An apparatus according to claim 41, wherein said collapsible linkage member comprises a plurality of chains extending between said upper vehicle support platform and said lower vehicle support platform.

48. An apparatus according to claim 41:

wherein, in said first vehicle loading position, said upper vehicle support platform is tilted at a predetermined angle relative to said flooring, and wherein, in said second and third vehicle loading positions said upper and lower vehicle support platforms are tilted in a particular position relative to said flooring which is opposite from the tilt of said first position.

49. An apparatus for storing vehicles according to claim 41, wherein said upper vehicle support platform comprises:

platform cradle composed of a plurality of load bearing members including a pair of elongated parallel side support members;

a platform member adapted in length and width to receive and support a vehicle, and including a lower cavity which is adapted to mechanically mate with said platform cradle.

50. An apparatus for storing vehicles according to claim 49:

wherein said rotatable connection member comprises:

a pair of plates adapted for pivotal connection to said pair of elongated parallel side support members of said platform cradle.

* * * * *